US009765278B2

(12) United States Patent
Stammer et al.

(10) Patent No.: US 9,765,278 B2
(45) Date of Patent: Sep. 19, 2017

(54) ENERGY EFFICIENT, TEMPORARY SHEAR THINNING SILOXANE LUBRICANTS AND METHOD OF USING

(71) Applicants: Dow Corning Corporation, Midland, MI (US); Northwestern University, Evanston, IL (US)

(72) Inventors: Andreas Stammer, Pont-a-Celles (BE); Manfred Jungk, Geisenheim (DE); Herbert Stoegbauer, Huenfelden (DE); Yip-Wah Chung, Wilmette, IL (US); Tobin J. Marks, Evanston, IL (US); Qian Jane Wang, Mt. Prospect, IL (US); Thomas J. Zolper, Cuba City, WI (US)

(73) Assignees: DOW CORNING CORPORATION, Midland, MI (US); NORTHWESTERN UNIVERSITY, Evanston, IL (US)

( * ) Notice: Subject to any disclaimer, the term of this patent is extended or adjusted under 35 U.S.C. 154(b) by 0 days.

(21) Appl. No.: 14/647,504

(22) PCT Filed: Nov. 27, 2013

(86) PCT No.: PCT/US2013/072129

§ 371 (c)(1),
(2) Date: May 27, 2015

(87) PCT Pub. No.: WO2014/085521

PCT Pub. Date: Jun. 5, 2014

(65) Prior Publication Data

US 2015/0299609 A1 Oct. 22, 2015

Related U.S. Application Data

(60) Provisional application No. 61/730,793, filed on Nov. 28, 2012.

(51) Int. Cl.
*C10M 107/50* (2006.01)
*C10M 169/04* (2006.01)

(52) U.S. Cl.
CPC ..... *C10M 169/042* (2013.01); *C10M 107/50* (2013.01); *C10M 2229/0415* (2013.01);
(Continued)

(58) Field of Classification Search
CPC .... C10M 2229/003; C10M 2229/0405; C10M 2229/0415; C10M 2229/0425
USPC ..... 508/208–215
See application file for complete search history.

(56) References Cited

U.S. PATENT DOCUMENTS 4,190,546 A * 2/1980 Kulik ..... C10M 171/002 508/208
4,449,415 A * 5/1984 Groenhof ..... C10M 107/50 476/7

(Continued)

FOREIGN PATENT DOCUMENTS

CN 101402735 A 4/2009
JP H05271677 A 10/1993
JP 2002194374 A 7/2002

OTHER PUBLICATIONS

Thomas Zolper et al: "Lubrication Properties of Polyalphaolefin and Polysiloxane Lubricants: Molecular Structure—Tribology Relationships," Tribology Letters, Kluwer Academic Publishers-Plenum Publishers, NE, vol. 48, No. 3, Aug. 24, 2012 (Aug. 24, 2012), pp. 355-365, XP035126047, ISSN: 1573-2711, DOI: 10.1007/S11249-012-0030-9 abstract; figure 1.

(Continued)

*Primary Examiner* — Ellen McAvoy
(74) *Attorney, Agent, or Firm* — Warner Norcross & Judd LLP

(57) ABSTRACT

A method of using energy-efficient lubricant compositions to reduce wear between two surfaces exposed to a high shear (Continued)

condition is provided. The lubricant compositions comprise polysiloxane base oils having alkyl, aryl, or a combination of alkyl and aryl functionality. The polysiloxane base oils may be defined according to the formula:

wherein R, and R' are independently selected, such that R is an alkyl group having between 1-3 carbon atoms; R' is an alkyl or aryl group having between 6 to 20 carbon atoms; and m and n are integers, such that 25<(m+n)<500 and the ratio of m/(m+n) is greater than 0.05 and less than 1.00.

18 Claims, 10 Drawing Sheets

(52) U.S. Cl.
CPC ..... *C10M 2229/0425* (2013.01); *C10N 2220/021* (2013.01); *C10N 2220/022* (2013.01); *C10N 2220/032* (2013.01); *C10N 2220/033* (2013.01); *C10N 2230/56* (2013.01); *C10N 2230/68* (2013.01); *C10N 2240/02* (2013.01); *C10N 2240/04* (2013.01); *C10N 2240/046* (2013.01); *C10N 2240/10* (2013.01)

(56) References Cited

U.S. PATENT DOCUMENTS 5,480,573 A * 1/1996 Durfee ..... C10M 171/001 252/572
6,348,437 B1 * 2/2002 Avery ..... C08L 83/04 252/77
6,602,830 B1 * 8/2003 Fey ..... C10M 169/00 252/78.3
6,623,399 B2 * 9/2003 Fey ..... C08G 77/04 192/21.5
7,553,429 B2 * 6/2009 Forbus ..... C09K 5/10 252/73
7,745,560 B2 * 6/2010 Schutz ..... C09G 3/00 508/110
8,071,514 B2 * 12/2011 Han ..... C07F 7/0852 508/202
8,642,520 B2 * 2/2014 Aguilar ..... C10M 169/04 508/207
8,796,190 B2 * 8/2014 Kato ..... H01L 23/3737 508/150
2005/0221998 A1 10/2005 Marumo et al.

OTHER PUBLICATIONS

European Patent Office, Rijswijk, Netherlands, International Search Report of International Application No. PCT/US2013/072129, mailed Feb. 24, 2014, 1 page.
"3.8 Methyl Long-Chain Alkyl Methylsilicone Oil", Huang Wenrun, Silicon Oil and Secondary Processed Products, Version 1, Chemical Industry Press Chemistry and Applied Chemistry Press, Jan. 2004, pp. 98-102.
English language abstract and machine translation for CN101402735(A) extracted from http://worldwide.espacenet.com database on Mar. 3, 2017, 10 pages.
English language abstract and machine translation for JPH05271677(A) extracted from http://worldwide.espacenet.com database on Jun. 14, 2017, 10 pages.
English language abstract and machine translation for JP2002194374(A) extracted from http://worldwide.espacenet.com database on Jun. 14, 2017, 15 pages.

* cited by examiner

A

B

C

A

B

C

ENERGY EFFICIENT, TEMPORARY SHEAR THINNING SILOXANE LUBRICANTS AND METHOD OF USING

CROSS REFERENCE TO RELATED APPLICATIONS

This application is the National Stage of International Application Serial No. PCT/US2013/072129 filed on Nov. 27, 2013, designating the United States and published in English, which claims the benefit of the filing date under 35 U.S.C. §119(e) of U.S. Provisional Application No. 61/730,793 filed Nov. 28, 2012, the entire contents of each of which are hereby incorporated herein by reference.

This disclosure relates generally to the use of lubricant compositions to reduce the film friction that occurs between two surfaces moved relative to one another under a high shear condition. More specifically, this disclosure relates to the use of lubricant compositions comprising polysiloxane base oils with alkyl functionality, aryl functionality, or a combination thereof.

The statements in this section merely provide background information related to the present disclosure and may not constitute prior art.

A variety of lubricant compositions ranging from natural and petroleum-derived hydrocarbons (mineral oils), to synthetic hydrocarbon-based and silicone-based polymers are currently available. The development of synthetic lubricants in recent decades has been the result of concerted efforts to optimize the rheological and tribological properties of the lubricants for use in diverse applications. A multitude of silicon-based polymers known as silanes (—Si—), silalkylenes (—Si—C—), silazanes (—Si—N—) and siloxanes (—Si—O—) have been developed for use in elastomers, coatings, surface modifiers, photoresist separation membranes, and soft contact lenses. Siloxanes, which are generally derived from silica (e.g., sand), have undergone the most extensive evaluation due to their commercial significance.

Siloxanes are polymeric structures that have silicon-oxygen backbones instead of carbon-carbon backbones as are typically found in hydrocarbons. The strength of the Si—O bond (~460 kJ/mol) exceeds that of the C—C bond (~348 kJ/mol). In addition, siloxane molecules are more flexible than the corresponding hydrocarbons because they exhibit less steric hindrance relative to chain rotation around the backbone structure. This low steric hindrance is attributed to factors including the longer Si—O bond (0.164 nm, cf. 0.153 nm for C—C), the oxygen atoms not being encumbered by side groups, and the greater Si—O—Si bond angle (about 143°, cf. about 110° for C—C—C). The enhanced flexibility of siloxanes allows for increased compactness, lower melting temperatures, and lower glass transition temperatures. In general, siloxanes are known to have exceptional oxidative stability, low bulk viscosity (and temperature-viscosity coefficient), water-repellency, biological inertness, and relatively low surface tension that allows them to be spread more evenly on a surface than conventional hydrocarbons.

Siloxanes are generally derived from reacting silicon with methyl chloride to produce dimethyldichlorosilanes, which are then mixed with water to produce silanols, followed by polymerization. One example of a conventional siloxane polymer is polydimethylsiloxane (PDMS). PDMS is composed of a backbone chain of alternating silicon and oxygen atoms with methyl groups bonded to the silicon atoms. PDMS is known to provide poor boundary lubrication properties. However, the replacement of methyl groups with other groups, such as phenyl groups, can lead to a reduction in boundary friction and wear. Unfortunately, such a replacement will also lead to an increase in the molecular rigidity of siloxane polymer when used in sufficient quantity. For example, polyphenylmethylsiloxane (PPMS), which has phenyl groups in place of a substantial number of methyl groups exhibits both increased wear resistance and oxidative stability, but also a decrease in molecular flexibility.

BRIEF SUMMARY OF THE INVENTION

The present disclosure generally provides for the use of polysiloxane base oil as an energy efficient lubricant to reduce the film friction between two surfaces when the surfaces move relative to one another, such that a high shear condition is generated. This high shear condition is defined by a shear rate that is between about 1,000 $sec^{-1}$ and about 100,000,000 $sec^{-1}$. The polysiloxane base oil corresponds to the structural formula:

S(I)

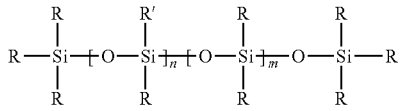

wherein R, and R' are independently selected, such that R is an alkyl group having between 1-3 carbon atoms; R' is an alkyl or aryl group having between 6 to 20 carbon atoms; m is an integer, and n is an integer or 0, such that 25<(m+n)<500 and the ratio of m/(m+n) is greater than 0.05 and less than 1.00.

According to one aspect of the present disclosure, the R in the polysiloxane base oil is a methyl group, the R' is an alkyl group with between 6-12 carbon atoms, and the sum of (m+n) is greater than 50 and less than 500, while the ratio of m/(m+n) is greater than 0.05 and less than 0.30. Alternatively, the R in the polysiloxane base oil is a methyl group and the R' is an octyl group.

According to another aspect of the present disclosure, the R in the polysiloxane base oil is a methyl group, the R' is an aryl group with between 6-12 carbon atoms, the sum of (m+n) is greater than 50 and less than 500, and the ratio of m/(m+n) is greater than 0.75 and less than 1.00. Alternatively the R in the polysiloxane base oil is a methyl group and the R' is a phenyl group.

According to another aspect of the present disclosure, the polysiloxane base oil corresponds to the structural formula:

S(II)

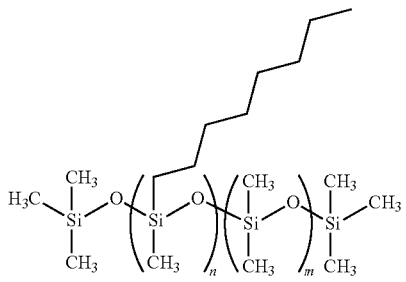

or

-continued

S(III)

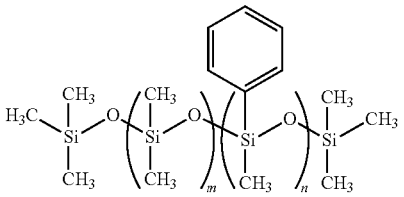

The energy efficient lubricant may also be a combination or mixture of at least a first and second polysiloxane base oil selected such that R' in the first polysiloxane base oil is an alkyl group and the R' in the second polysiloxane base oil is an aryl group. For example, the first and second polysiloxane base oils may be represented by the SOD and S(III) structures.

The polysiloxane base oils exhibit an initial viscosity ($\eta_o$) that decreases to an effective viscosity ($\eta_{eff}$) when exposed to the high shear condition. Alternatively, the ratio of $\eta_{eff}/\eta_o$ is between about 0.99 and about 0.05; alternatively between about 0.99 and 0.25; alternatively, between about 0.95 and 0.50. The polysiloxane base oil present in the energy efficient lubricant exhibits a total mass in excess of about 10,000 g/mol; alternatively, between about 10,000 g/mol and 75,000 g/mol; alternatively between about 10,000 g/mol and about 35,000 g/mol. When desirable, the energy efficient lubricant composition may further comprise at least one functional additive selected as one from the group of extreme pressure additives, anti-wear additives, antioxidants, antifoams, and corrosion inhibitors.

According to another aspect of the present disclosure, the two surfaces, between which the lubricant composition is placed, represents an elastohydrodynamic lubrication (EHL) contact point in a machine element. Alternatively, the machine element may be a rolling element bearing, a sliding bearing, a gear, a cam and a cam follower, or a traction drive. Alternatively, the two surfaces may be ceramic or metal surfaces; alternatively, the two surfaces are metal surfaces.

The energy efficient lubricant provides an EHL film thickness on the surface that is less than about 2,000 nm; alternatively, between 10 and 2,000 nm; alternatively, less than 1,000 nm. The lubricant exhibits a coefficient of friction that is less than about 0.05 at a temperature of 398 K and an entrainment speed between about 0.05 and 5.00 m/s. Alternatively, the lubricant exhibits a coefficient of friction that is less than 0.25 when the shear rate that is less than 1,000 $sec^{-1}$.

A method of reducing the film friction between rolling or sliding surfaces in a machine element is also provided in which the method comprises the steps of providing a machine element having a first surface and a second surface; providing a lubricant composition between the first surface and second surface, and allowing the first surface to roll or slide past the second surface such that a high shear condition is established. This high shear condition being defined by a shear rate that is between about 1,000 $sec^{-1}$ and 100,000,000 $sec^{-1}$. The lubricant composition exhibits a coefficient of friction that is less than 0.07 at a temperature of at least 303 K with a film thickness of 10 nm or more. In this method, the first and second surfaces represent an elastohydrodynamic lubrication (EHL) contact point in the machine element. The machine element and the lubricant composition comprise the surfaces and polysiloxane base oil placed there between as previously described above and further described hereafter.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
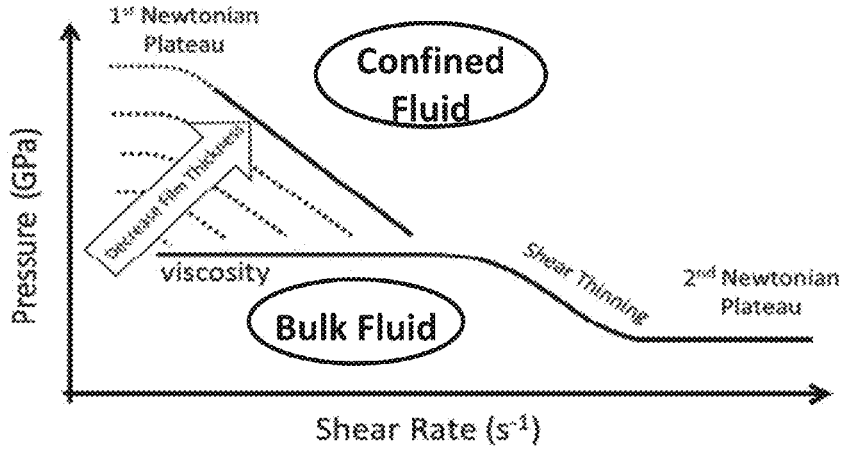
FIG. 1 is a graphical depiction of the shear thinning behavior for lubricant compositions.
Figure 2:
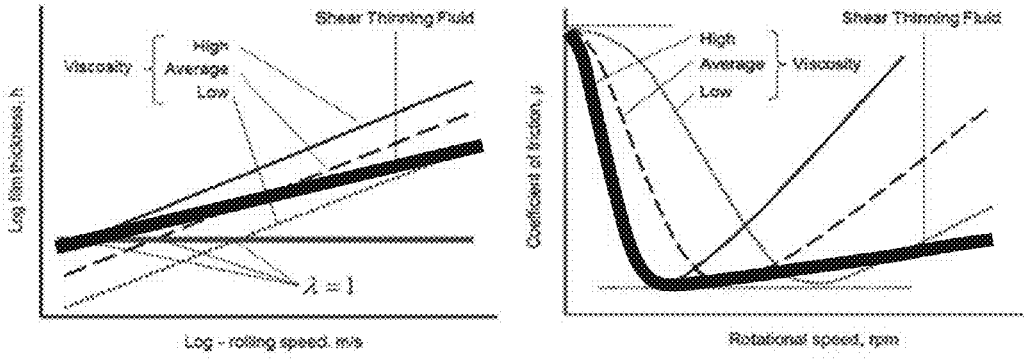
FIG. 2 is a graphical depiction of the effects of shear thinning on film formation and friction coefficient.

The following description is merely exemplary in nature and is in no way intended to limit the present disclosure or its application or uses. It should be understood that throughout the description, corresponding reference numerals indicate like or corresponding parts and features.

The present disclosure generally relates to a method of reducing film friction between rolling or sliding surfaces in a machine element. More specifically, the present disclosure relates to the use of an energy-efficient lubricant composition comprising one or more polysiloxane base oils, which is free of non-silicone base oil, capable of reducing the film friction that occurs between two mechanical surfaces when the surfaces are moved relative to one another under a high shear condition.

The lubricant compositions used according to the teachings contained herein are described throughout the present disclosure in conjunction with various test configurations that are appropriate for measuring wear and rheological properties, such as a thin film ball on disk wear test defined herein in order to more fully illustrate the concept. The incorporation and use of these lubricant compositions in conjunction with other types of sliding or rolling contacts, such as those found in various machine elements, including but not limited to, rolling element bearings, sliding bearings, gears, cams and cam followers, or traction drives, is contemplated to be within the scope of the disclosure.

Alkyl groups, such as hexyl, octyl, and dodecyl groups can be grafted onto the backbone or chain structure of polysiloxanes to improve their lubricating properties. Polyalkylmethylsiloxanes (PAMS) have alkyl groups of varying length attached to the silicon atoms of the polymeric backbone. The use of such alkyl groups can improve the boundary friction, hydrodynamic friction and wear resistance of the siloxane polymers when incorporated in a high percentage. A similar effect is observed for the incorporation of aryl groups.

According to one aspect of the present disclosure, the lubricant composition prepared and used according to the teachings of the present disclosure includes a polysiloxane base oil having a structure described by structure S(I). In structure S(I), R and R' are independently selected to comprise linear or branched alkyl functionality or aryl functionality, alternatively, R is an alkyl group having between 1-3 carbon atoms; R' is an alkyl or aryl group having between 6-20 carbon atoms; m is an integer, and n is an integer or 0, such that $25<(m+n)<500$ and $0.05<m/(m+n)<1.00$. Alternatively, R is a methyl group and R' is an alkyl group with between 6-12 carbon atoms; and $50<(m+n)<500$ and $0.05<m/(m+n)<0.30$. Alternatively, R is a methyl group and R' is an aryl group with between 6-12 carbon atoms; and $50<(m+n)<500$ and $0.75<m/(m+n)<1.00$. Optionally, the R or R' may also include the substitution of a hydrogen atom with a functional ligand, such as a halogen atom, e.g., fluorine, an amino group, or a carboxyl group, among others.

S(I)

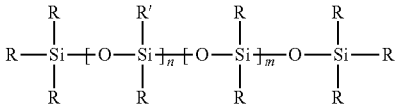

According to another aspect of the present disclosure, the polysiloxane base oil S(I) includes R as a methyl group and R' either as an octyl group or a phenyl group. The polysiloxane base oil in which R' is an octyl group can be further described by structure S(II). Similarly, the polysiloxane base oil in which R' is a phenyl group can be further described by structure S(III). In both of these specific examples, m and n, correspond to the descriptions previously provided above.

S(II)

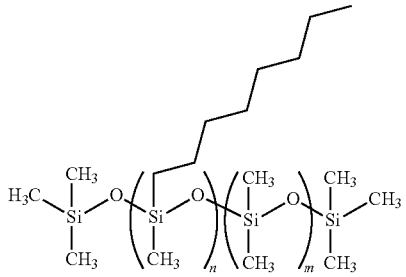

or

S(III)

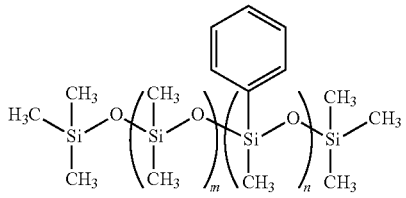

According to another aspect of the present disclosure, the energy efficient lubricant composition may comprise more than one polysiloxane base oil. The lubricant composition may comprise a mixture of at least a first and second polysiloxane base oil selected such that R' in the first polysiloxane base oil is an alkyl group and R' in the second polysiloxane base oil is an aryl group. The ratio of the first polysiloxane base oil to the second polysiloxane base oil may be between about 0.01 to about 0.99; alternatively, between about 0.25 to about 0.75; alternatively, between about 0.40 to about 0.60; alternatively, between about 0.75 to about 0.25; alternatively between about 0.99 to about 0.01. In one specific example, the first polysiloxane base oil may be described according to structure S(II), while the second polysiloxane base oil may be described according to structure S(III), One skilled in the art will understand that although Structure S(I) is shown to include only M units ($R_3SiO_{1/2}$) and D units ($R'RSiO_{2/2}$), such structure may also comprise T units ($R''SiO_{3/2}$) or Q units ($SiO_{4/2}$) as branch points resulting in the crosslinking of polysiloxane backbones or chains without exceeding the scope of the present disclosure. The R" group associated with any T unit that is present in the polysiloxane base oil may be independently selected and defined similarly as to the descriptions provided for the R or R' groups above. The number of T units or Q units present in the polysiloxane base oil may be predetermined according to the viscosity and lubrication properties desired for the lubricant when used in a specific application.

According to yet another aspect of the present disclosure, the polysiloxane base oil has a total molecular mass in excess of about 10,000 g/mol; alternatively, between about 25,000 g/mol and 75,000 g/mol; alternatively, between about 10,000 g/mol and about 35,000 g/mol. The polysiloxane base oils exhibit an initial viscosity ($\eta_o$) that decreases to an effective viscosity ($\eta_{eff}$) when exposed to a high shear condition. The ratio of effective viscosity to initial viscosity ($\eta_{eff}/\eta_o$) ranges between about 0.99 to about 0.05; alternatively between about 0.99 to about 0.25; alternatively, between about 0.99 to about 0.50. The initial viscosity of the polysiloxane base oil may range at zero shear and 303K between 50 mPa·s (centipoise) and 5,000 mPa·s (centipoise);

alternatively, between 50 mPa·s and about 3,500 mPa·s; alternatively, between about 250 mPa·s and 5,000 mPa·s.

The high shear condition is defined by a shear rate that is between 1,000 $sec^{-1}$ and 100,000,000 $sec^{-1}$. Alternatively, the high shear condition is between 1,000 $sec^{-1}$ and 10,000,000 $sec^{-1}$; alternatively between 1,000 $sec^{-1}$ and 1,000,000 $sec^{-1}$; alternatively between 10,000 $sec^{-1}$ and 100,000 $sec^{-1}$. One skilled in the art will understand that shear rate may be empirically determined based on the physical geometry and operating parameters of the mechanical element and associated rolling or sliding surfaces (e.g., entrainment speed, etc.). A specific example is provided herein with respect to the shear rate established between two moving surfaces within the wear test cell or rig configuration used with the polysiloxane bases oils of the present disclosure.

The energy-efficient lubricants of the present disclosure undergo temporary shear thinning when exposed to the high shear rate encountered at the tribological interface. If a viscous fluid temporarily decreases in viscosity at high shear rate, low friction may be realized when a full film is formed due to a high running speed. The viscosity of non-Newtonian fluids, such as high molecular mass polymer liquids, depends on temperature, shear rate, pressure, average molecular mass, and molecular mass distribution. Non-Newtonian fluids are often described as either shear-thinning or shear-thickening. Temporary shear thinning occurs when the fluid strain rate reaches a critical value where the time for the lubricant molecules to transit through the interface is less than the molecular relaxation time whereby the Brownian motion returns aligned molecules to a random position.

Conventionally, non-Newtonian fluids are either described as being shear-thinning or shear-thickening. Some lubricants exhibit non-Newtonian properties, e.g., shear thinning, especially at high molecular masses and strain rates. The viscosity of non-Newtonian fluids depends on shear rate and molecular mass in addition to conditions such as temperature and pressure. Temporary shear thinning occurs when the lubricant molecules align in the direction of motion in a tribological interface. The alignment of the lubricant molecules creates a pathway that reduces the resistance to successive molecules that move through the interface. Evidence for shear thinning can be established theoretically by kinetic theory and experimentally by flow birefringence. Additional support for the role of molecular alignment in shear thinning can be obtained from molecular dynamics simulations. Temporary shear thinning fluids do not suffer permanent viscosity breakdown, but if the shear thinning behavior is too strong, then it can lead to film failure and increased boundary friction due to wear.

Temporary shear thinning occurs when the fluid strain rate reaches a critical value where the time for the lubricant molecules to transit through the interface is less than the molecular relaxation time, whereby, the Brownian motion returns aligned molecules to a random position. The molecular relaxation time (A) is often approximated by the Einstein-Debye relation ($\lambda_{EB}$) which is approximately equal to the Rouse equation ($\lambda_{Rouse}$) as shown in Equation 1. Relaxation time increases with increasing molecular mass (M) and decreases as temperature increases (T). Additional factors that influence relaxation time include the density ($\rho$), viscosity ($\eta$), and ideal gas constant ($R_g$). The relaxation time is originally derived to describe the time for molecules to return to random orientations after being aligned by an electric field.

$$\lambda_{EB} = \frac{\eta M}{\rho R_g T} \approx \lambda_{Rouse} = \frac{12\eta M}{\pi^2 \rho R_g T} \quad \text{Eq. (1)}$$

Shear thinning fluids typically exhibit a constant viscosity, known as the "$1^{st}$ Newtonian Plateau" ($\eta_1$), up to a critical strain rate ($\dot{\gamma}_{er}$) as shown in FIG. 1. When the reciprocal of the critical strain rate exceeds the molecular relaxation time, the fluid becomes shear thinning and has a variable shear viscosity ($\eta_s$) that decreases with increasing strain rate. Some fluids also have a "2nd Newtonian Plateau" ($\eta_2$), however it is not always present or detectable.

Molecular relaxation time increases significantly in confined spaces and may exceed theoretical values for individual molecules by collective motion Shear thinning in polydimethylsiloxane, PDMS ($M_w$=10,000-80,000 g/mol) and other polymers begin to occur at lower shear rates when such fluids are under high pressure. A universal shear thinning model that fully describes this phenomenon is shown in FIG. 1.

The film thickness of a fluid that is undergoing shear thinning is less than that of a Newtonian fluid, so a correction must be made to the predicted film thickness. This correction includes a correction factor ($\phi$) that uses the velocity, viscosity, Newtonian film thickness ($h_N$) and the shear modulus (G) to calculate shear thinning behavior according to Equation 2. This correction factor has been used to successfully predict the film thickness of shear thinning polyalphaolefins (PAO) and polydimethylsiloxane (PDMS).

$$\phi = \frac{h_N}{h_{NN}} = \left[1 + 4.44\left(\frac{U\eta_0}{h_N G}\right)^{1.69}\right]^{1.26(1-n)^{1.78}} \quad \text{Eq. (2)}$$

The exponent (n) in Equation 2 is the logarithmic slope of the shear stress in relation to the shear rate, an indicator of the extent and severity of shear thinning behavior for a given fluid as described in Equation 3. It is measured by a shear viscometer.

$$n = \frac{\partial \log\tau}{\partial \log\dot{\gamma}} \quad \text{Eq. (3)}$$

Typically, shear thinning begins at lower strain rates in fluids under high pressure. Since polymers of different compositions may take on similar shear thinning characteristics at high pressures, the phenomenon can be described by the shear thinning model shown in FIG. 1. Using the film thickness correction factor ($\phi$), the film thickness and hydrodynamic friction coefficient can be calculated, as well as significant reductions in viscous friction can be projected for the use of shear thinning lubricants in a gear box. In fact, substantial energy savings may be achievable when a shear thinning lubricant is used in a gear box.

The viscosity and shear behavior exhibited by different siloxane lubricants can be influenced by varying the percent branching (Q), alkyl branch length (L) and overall polymer length (Z) in the molecular structure. In the present disclosure, the percentage of phenylmethyl branches in polyphenylmethylsiloxanes (PPMS) can range from about 10% to about 90% and the percentage of alkylmethyl branches in polyalkylmethylsiloxanes (PAMS) can range from about 8% to about 100%. Thus the term polyphenylmethylsiloxane (PPMS) as used herein describes poly(phenylmethyl dimethyl)siloxane polymers, while the term polyalkylmethylsiloxanes (PAMS) refers to both poly(alkylmethyl)siloxane and poly(alkylmethyl dimethyl)siloxane polymers.

Permanent viscosity breakdown known as 'molecular scission' is generally undesirable and occurs when the polymers of a lubricant are mechanically broken down into shorter-lower mass segments. The damage is permanent and the viscosity loss is not recoverable. Industrial lubricants are often required to pass a series of stringent shear tests to determine their permanent shear stability index (PSSI). These tests include the Sonic Shear Test (ASTM D2603 and ASTM 5621), the Mechanical Shear Test (ASTM D6278), the Kurt Orbhan test, a FZG shear test and the KRL (Kugel Rollen Lager) or Tapered Roller Bearing (TRB) test codified as CEC L45-T-93.

Siloxanes are more resilient to permanent viscosity breakdown than competing hydrocarbons. In fact, polysiloxanes can exhibit a permanent shear threshold that is an "order of magnitude greater than that of organic polymers", which can be attributed to the high rotational freedom and bond strength of siloxanes. The shear stability of siloxanes may extend the service life of a siloxane based lubricant in comparison to hydrocarbon based lubricants that serve the same function.

The film forming ability of the polysiloxane base oils is represented by a film thickness model that includes parameters, such as atmospheric viscosity, entrainment velocity (U), and pressure-viscosity index (a). This model, as shown in Equation 4 is a simplification of the Hamrock-Dowson film thickness equations by condensing the interface parameters into a constant (k).

$$h_{oil}=kU^{0.67}\eta_0^{0.67}\alpha^{0.53} \quad \text{Eq. (4)}$$

In order to determine the extent of shear thinning or viscosity reduction of the lubricants, Equation 4 is rearranged to determine the effective viscosity ($\eta_{eff}$) from film thickness measurements as shown in Equation 5.

$$\eta_{eff}=\left(\frac{h_{oil}}{kU^{0.67}\alpha^{0.53}}\right)^{\frac{1}{0.67}} \quad \text{Eq. (5)}$$

A reduced effective viscosity ($\eta_{red}$) may also be defined as the quotient of the effective viscosity to the bulk viscosity ($\eta_0$) of the oil as shown in Equation 6. The reduced effective viscosity is calculated in order to provide a direct comparison of the extent of shear thinning between different base oils.

$$\eta_{red}=\frac{\eta_{eff}}{\eta_0} \quad \text{Eq. (6)}$$

The following specific embodiments are given to illustrate the design and use of polysiloxane base oils in lubricant compositions according to the teachings of the present disclosure and should not be construed to limit the scope of the disclosure. Those skilled-in-the-art, in light of the present disclosure, will appreciate that many changes can be made in the specific embodiments which are disclosed herein and still obtain alike or similar result without departing from or exceeding the spirit or scope of the disclosure.

Example 1—General Measurement Techniques

The physical and chemical properties exhibited by the energy efficient lubricant prepared according to the teachings of the present disclosure are measured using the equipment and test protocols or procedures described below and herein. One skilled in the art will understand that any properties reported herein represent properties that are routinely measured and can be obtained by multiple different methods. The methods described herein represent one such method and other methods may be utilized without exceeding the scope of the present disclosure.

Gel permeation chromatography (GPC) is used to obtain the molecular mass distributions of the polymer samples. The weight average molecular mass ($M_w$) can influence many polymer properties, such as viscosity. The siloxane branch content is determined using an INOVA 400/Mercury 400 NMR. The density (ρ) and kinematic viscosity (υ) are measured simultaneously over a temperature range of 303 K to 398 K in increments of 25K using a Cannon CT-2000 constant temperature bath with microprocessor control. The density is determined by precision measurements of the mass and volume of each sample. The kinematic viscosity is measured using Cannon-Fenske capillary viscometers. The absolute viscosity (η) is obtained from the kinematic viscosity and the density.

Figure 3:
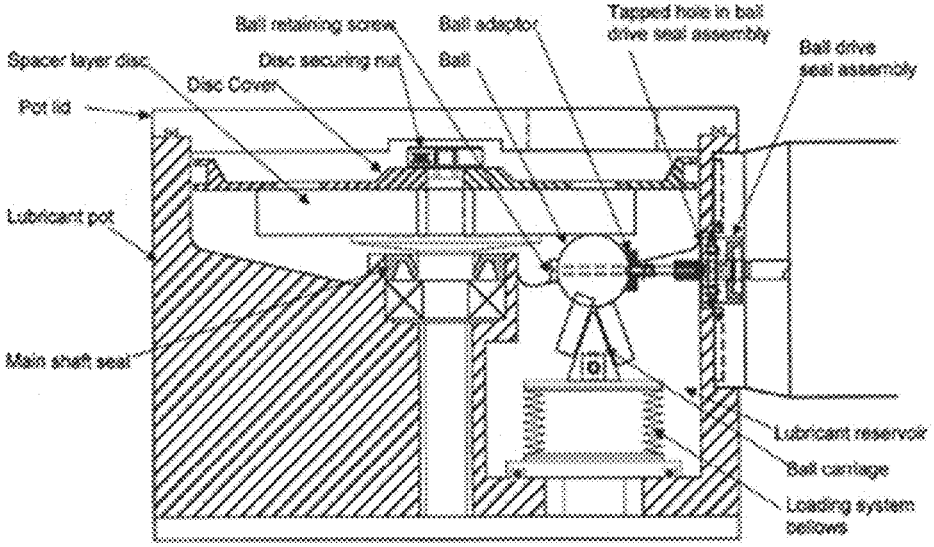
FIG. 3 is a cross-sectional depiction of an elastohydrodynamic (EHD) rig for use in film thickness and friction measurements.

Elastohydrodynamic lubrication (EHL) film thickness (h) is measured with a thin-film tribometer over a temperature range of 303 to 398 K using the instrument shown in FIG. 3. The temperature is held constant to +/−1 K for each test in the temperature sequence. The system uses a polished steel ball (AISI 52100, high carbon tool steel) of 19.050 mm diameter which is pressed against a transparent glass disk with a 500 nm thick silica spacer layer under a 20 N load. The assembly is able to measure ultrathin films with repeatability up to 1 nm for films under 30 nm and repeatability within 5% for films above 30 nm.

Still referring to FIG. 3, during the test, the ball is partly immersed in the fluid samples which allows for fluid transfer to the ball-disk interface. The disk rotation is varied in velocity increments of 40% to cover a velocity range of 0.020 m/s to 4.35 m/s at the radius chosen. Measurements of film thickness are undertaken in nominally pure rolling conditions with the ball allowed to rotate freely. Additional measurements are made on several fluids to determine if shear thinning occurs. In those tests, the ball is attached to a motor driven shaft and the slide to roll ratio (Σ), as defined in Equation 7, is varied from pure rolling (Σ=0) to pure sliding (Σ=2).

$$\Sigma=\frac{slidingspeed}{entrainmentspeed}=\frac{|U_1-U_2|}{(U_1+U_2)/2} \quad \text{Eq. (7)}$$

Measurements of friction coefficient (p) at different modes of lubrication are made with the friction testing capability of the same tribometer used to measure film thickness. Measurements are also made over a temperature range of 303 to 398 K under temperature controlled conditions held constant to +/−1 K for each test in the temperature sequence. The friction test is also undertaken using a steel ball (AISI 52100) of 19.050 mm diameter placed under load of 20 N in Hertzian contact with a steel disk. The ball is partly immersed in the fluid samples to allow fluid transfer to the ball-disk interface. The disk velocity is varied to achieve a velocity range 0.025 to 5.00 m/s at the radius chosen. The friction coefficient is measured at Σ=0.25, 0.50, 0.75 and 1.00 at each speed.

Boundary friction (μ) is measured at room temperature (303 K) using a CETR ball-on-disk tribometer. The friction test is undertaken using a steel ball (AISI 52100) of 9.50 mm diameter placed under load of 50 N in Hertzian contact with a steel disk. The steel ball (HRC~60) is harder than the steel disk (HRC~35) resulting in measurable wear on the disk. The ball is immersed in the fluid samples to allow fluid transfer to the ball-disk interface. The disk velocity is set to 0.05 m/s at the radius chosen to give an entrainment speed of 0.025 m/s at an effective slide to roll ratio of Σ=2.00.

Measurements of the wear scar depth and wear volume ($mm^3$) are made with an interferometry microscope with statistical distribution and wear profile integration capability. The boundary friction and wear measurements are repeated with high accuracy using multiple samples.

Example 2—Preparation of Polysiloxane Base Oils

Several examples of polysiloxane base oils having a R and R' attached to a silicon atom in the backbone of the polysiloxane similar to that shown as structure S(I) being a methyl group and either aryl or alkyl functionality, respectively, include poly(phenylmethyl)siloxane, poly(octylmethyl)siloxane, and poly(dodecylmethyl)siloxane when in each case referring to S(I) m is zero or the equivalent copolymer poly(phenylmethyl dimethyl)siloxane, poly(octylmethyl dimethyl)siloxane, and poly(dodecylmethyl dimethyl)siloxane when m is 1 or more. Various poly(arylmethyl)siloxanes and poly(arylmethyl dimethyl)siloxane copolymers or PPMS may be obtained commercially, such as poly(phenylmethyl)siloxane (Dow Corning Corporation, Midland Mich.) or synthesized according to any manner known to one skilled in the art. Various poly(alkylmethyl)siloxanes and poly(alkylmethyldimethyl)siloxane copolymers or PAMS may be each synthesized according to the following manner, as well as any other manner known to one skilled in the art. For example, poly(octylmethyl dimethyl)siloxane is synthesized by the hydrosilation of 1-octene with poly (methylhydridedimethyl)siloxane using $(CpH)_2PtCl_2$ as the catalyst according to Equation 8. This reaction is undertaken with no solvent and takes approximately 4 hours to complete. The excess 1-octene is then isomerized and removed under static vacuum. The final product is filtered through silica-gel to remove the catalyst and stored until future use. Samples of the final products are collected and stored for testing and evaluation for use as polysiloxane base oils according to the teachings of the present disclosure. More specifically, as indicated in Table 1 four samples of poly (phenylmethyl dimethyl)siloxane having different amounts of phenylmethyl D units are stored as sample No.'s PPMS-1 to PPMS-4. A total of six samples of PAMS are stored as sample No.'s PAMS-1 to PAMS-6 in which PAMS-1 and PAMS-5 represent poly(octylmethyl dimethyl)siloxanes, while PAMS-2 and PAMS-6 represent poly(dodecylmethyl dimethyl)siloxanes, PAMS-3 represents a poly(octylmethyl) siloxane and PAMS-4 represents a poly(dodecylmethyl) siloxane. In each example the polymer is terminated with trimethylsilyl end groups.

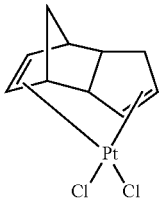

Dicyclopentadienyl platinum chloride

-continued

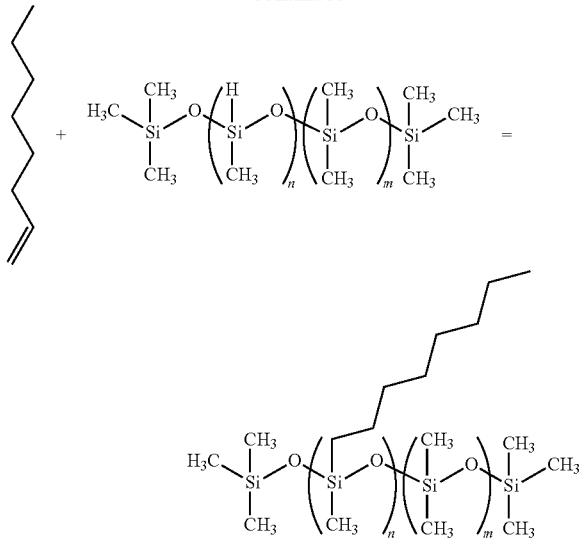

Eq. (8)

Several samples of conventional polysiloxane lubricants are obtained and stored for future use in comparing their lubricating properties against the properties exhibited by the polysiloxane base oils of the present disclosure. The conventional polysiloxane base oils include polydimethylsiloxane (PDMS) obtained as Dow Corning® 200 Fluid from Dow Corning Corporation, Midland, Mich. as different viscosity liquids. The viscosity of the Dow Corning® 200 Fluid obtained and stored as conventional oil #'s C-1 to C-6 is stated to be 10 $mm^2 \cdot s^{-1}$ (cSt), 20 $mm^2 \cdot s^{-1}$ (cSt), 50 $mm^2 \cdot s^{-1}$ (cSt), 100 $mm^2 \cdot s^{-1}$ (cSt), 300 $mm^2 \cdot s^{-1}$ (cSt), and 1000 $mm^2 \cdot s^{-1}$ (cSt).

Example 3—Characterization of Polysiloxane Base Oils and Use Thereof

The typical physical and chemical properties exhibited by the polysiloxane base oils labeled as sample #'s PPMS-1 to PPMS-4 and PAMS-1 to PAMS-6 are summarized in Table 1 along with the properties of several conventional oils (Sample #'s C-1 to C-6). These properties include information regarding molecular structure, mass, density, and viscosity including the percent branching, the type of branching, degree of polymerization (DP) and polydispersity (PD).

The percent branch content of the PPMS-1 to PPMS-4 samples includes 10%, 50% and 90%, as determined through analysis of nuclear magnetic resonance (NMR) data. The alkylmethylsiloxanes with either octylmethyl D units (PAMS-1, PAMS-3, & PAMS-5) or dodecylmethyl D units (PAMS-2, PAMS-4, & PAMS-6) each included a respective D unit content of 8%, 30%, and 100%.

Still referring to Table 1, the density and viscosity of the base oil samples and conventional oils is provided at two temperatures, namely, 303K and 398K. Generally, an increase in density is observed to occur along with the molecular mass for polymers of similar molecular structure. The PPMS samples had the highest density which increased with increasing phenyl content. Base oil sample #'s PPMS-1 to PPMS-4 exhibit a viscosity at 30° C. (303K) in the range of about 92 mPa·s (centipoise) to about 472 mPa·s (centipoise), while sample #'s PAMS-1 to PAMS-6 exhibit a viscosity under the same conditions that ranges between about 91 mPa·s to about 1295 mPa·s. In comparison, the viscosity measured for the conventional oil samples #'s C-1 to C-6 ranges between about 8 mPa·s and about 937 mPa·s. Generally, base oil sample viscosity is observed to increase with polymer length, branch content, and branch length.

TABLE 1

| | | Molecular Structure | | | Molecular Mass (g/mol) | | Density ($g/cm^3$) | | Viscosity (mPa · s) | |
|---|---|---|---|---|---|---|---|---|---|---|
| Sample | | % D Units | D Unit | DP | $M_w$ | PO | 303 K | 398 K | 303 K | 398 K |
| PDMS | C-1 | 100 | dimethyl | 18 | 1750 | 1.19 | 0.88 | 0.81 | 8 | 7 |
| | C-2 | 100 | dimethyl | 31 | 3270 | 1.32 | 0.92 | 0.84 | 17 | 14 |
| | C-3 | 100 | dimethyl | 59 | 8090 | 1.35 | 0.93 | 0.85 | 43 | 35 |
| | C-4 | 100 | dimethyl | 87 | 9930 | 1.51 | 0.94 | 0.87 | 102 | 86 |
| | C-5 | 100 | dimethyl | 135 | 19900 | 1.95 | 0.95 | 0.87 | 262 | 218 |
| | C-6 | 100 | dimethyl | 222 | 32000 | 1.93 | 0.96 | 0.83 | 937 | 781 |
| PPMS | PPMS-1 | 10 | phenylmethyl | 60 | 8180 | 1.63 | 0.97 | 0.89 | 92 | 76 |
| | PPMS-2 | 10 | phenylmethyl | 115 | 26600 | 2.83 | 0.99 | 0.90 | 443 | 360 |
| | PPMS-3 | 50 | phenylmethyl | 17 | 2690 | 1.42 | 1.05 | 0.98 | 126 | 99 |
| | PPMS-4 | 90 | phenylmethyl | 9 | 1990 | 1.50 | 1.07 | 1.00 | 472 | 264 |
| PAMS | PAMS-1 | 30 | octylmethyl | 39 | 9630 | 2.31 | 0.91 | 0.83 | 91 | 70 |
| | PAMS-2 | 30 | dodecylmethyl | 37 | 8510 | 1.83 | 0.92 | 0.85 | 126 | 94 |
| | PAMS-3 | 100 | octylmethyl | 46 | 24000 | 2.98 | 0.93 | 0.86 | 924 | 648 |
| | PAMS-4 | 100 | dodecylmethyl | 49 | 29900 | 2.67 | 0.91 | 0.83 | 1296 | 861 |
| | PAMS-5 | 8 | octylmethyl | 73 | 14600 | 2.35 | 0.97 | 0.88 | 182 | 148 |
| | PAMS-6 | 8 | dodecylmethyl | 80 | 15300 | 2.18 | 0.96 | 0.88 | 205 | 164 |

Figure 4:
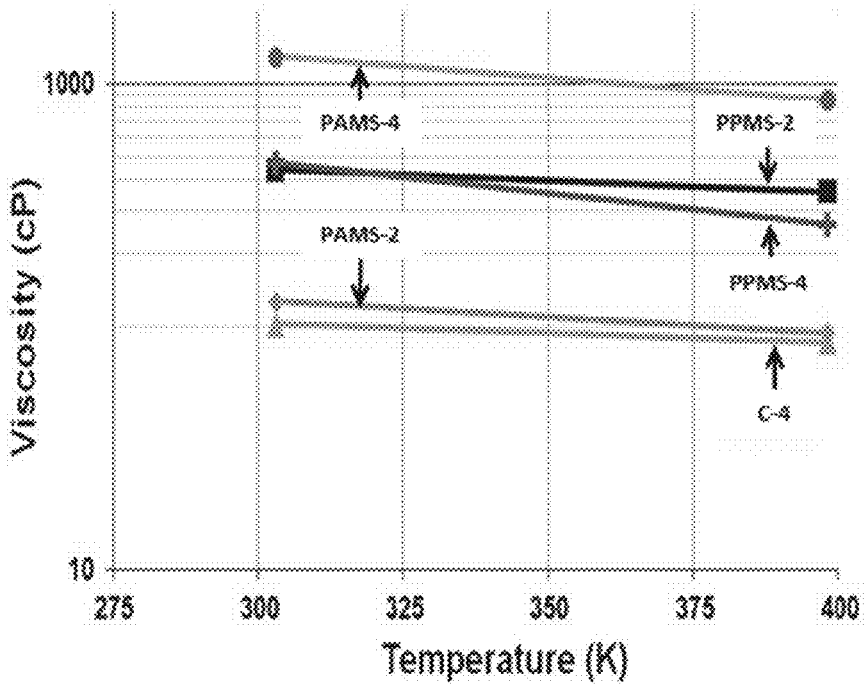
FIG. 4 is a graphical representation of viscosity exhibited by conventional oils and polysiloxane base oils prepared according to the teachings of the present disclosure plotted as a function of temperature.

Referring now to FIG. 4, the effect of molecular structure on molecular mass and consequently viscosity is most evident in the masses of the PPMS base oil samples, where similar viscosity can be obtained by different molecular masses, through variation of the polymer length and phenyl branch content. The viscous thermal stability of polydimethylsiloxane, PDMS (sample C-4) decreases in fluids having high branch content, such as that exhibited by the PAMS and PPS samples. For example, the viscosity of the PPMS base oil with 10% phenylmethyl (PPMS-2) is nearly the same as that of the sample with 90% phenylmethyl content (PPMS-4), but the molecular mass is significantly greater. This also occurs in PAMS base oil samples where the mass (PAMS-4) is about three times greater than PAMS-2, but the viscosity (at 303K) is over ten times greater. For a siloxane with low aryl/alkyl content to attain the same viscosity as a siloxane with high aryl/alkyl content, a much greater polymer length (Z) or effectively degree of polymerization (DP) is required.

Figure 5:
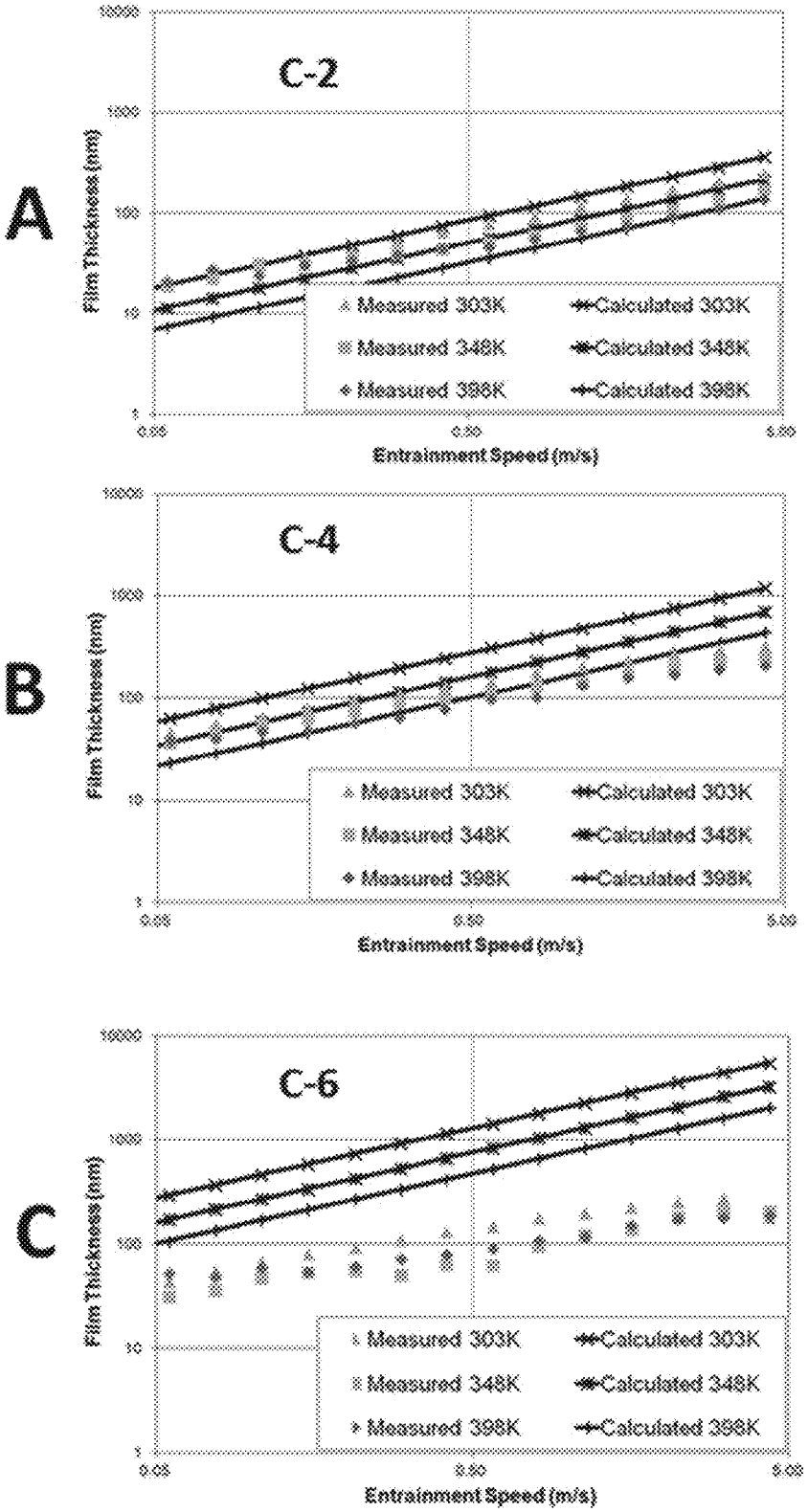
FIGS. 5(A-C) are graphical representations of elastohydrodynamic liquid (EHL) film thickness exhibited by conventional base oils plotted as a function of entrainment speed at various temperatures.

Referring now to FIGS. 5(A-C), 6(A-C), & 7(A-C), measurements of film thickness plotted against entrainment speed is provided for conventional PDMS oil samples (FIG. 5A-5C), PPMS base oil samples (FIGS. 6A-6C), and PAMS base oil samples (FIG. 7A-7C). The film thicknesses predicted by the Hamrock-Dowson equations (see Equation 4) are also plotted using the measured viscosity and interpolated pressure-viscosity at the same temperatures as the film formation measurements. The logarithmic slope approached 0.67 for PDMS, PPMS, and PAMS samples that did not exhibit shear thinning behavior. The film thickness at a given speed decreases with increasing temperature due to the decrease in the viscosity and the pressure-viscosity index.

The film thickness for the different lubricant base oils was calculated from their viscosity and pressure-viscosity indices (a*) according to Equation 4. The pressure-viscosity indices for PDMS, PPMS and PAMS were obtained by curve fitting to conventional published literature data. The pressure-viscosity index of PDMS and PAMS is relatively stable near 13 $GPa^{-1}$, decreasing slightly with temperature. The pressure-viscosity index of PPMS with high phenylmethyl content is around 27 $GPa^{-1}$, but decreases significantly at higher temperatures Referring now to FIGS. 5(A-C), Equation 4 accurately predicts film thickness for lower molecular mass samples of conventional PDMS oils (C-2, FIG. 5A). The equation over-predicts the film thickness for intermediate mass samples (C-4) at higher velocities (FIG. 5B). In cases such as high molecular mass PDMS (C-6), the film thickness did not increase in proportion to bulk viscosity. Shear thinning becomes most pronounced in high molecular mass samples, such as C-6 (FIG. 5C). The film thickness curve of the PDMS with the highest viscosity (C-6) was nearly the same as that of an intermediate mass PDMS (C-4) although its viscosity was ten times greater. The discrepancy between measured and calculated film thickness may be attributed to the occurrence of temporary shear thinning behavior in high molecular mass PDMS (C-6).

Figure 6:
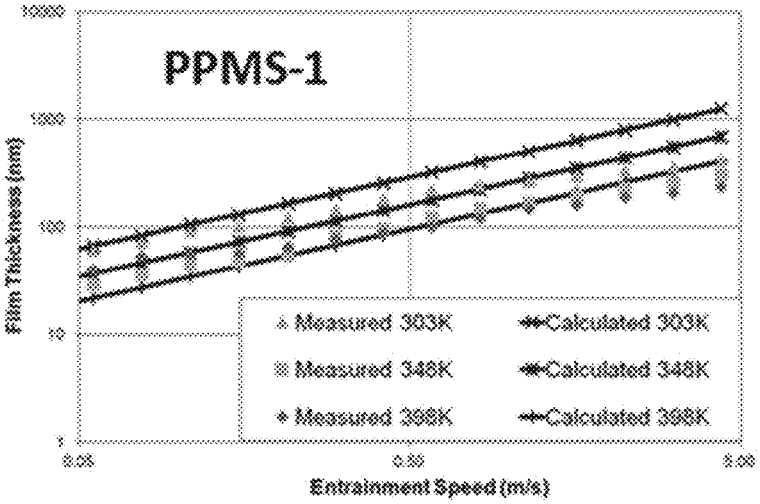
FIGS. 6(A-C) are graphical representations of elastohydrodynamic liquid (EHL) film thickness exhibited by polyphenylmethylsiloxane (PPMS) base oils plotted as a function of entrainment speed at various temperatures.
Figure 6:
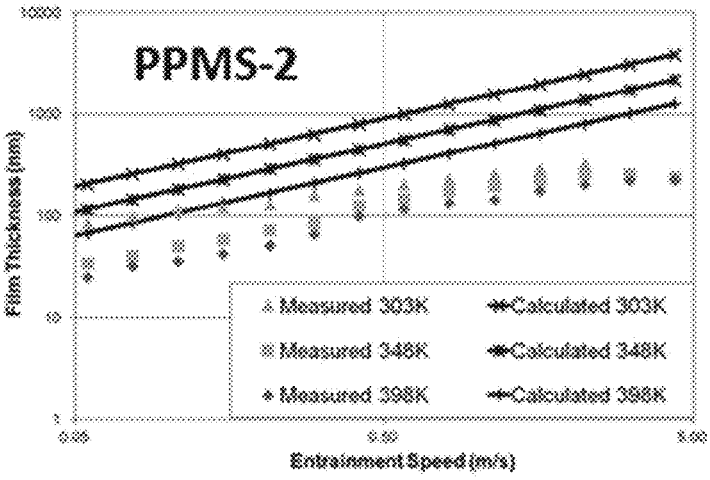
Figure 6:
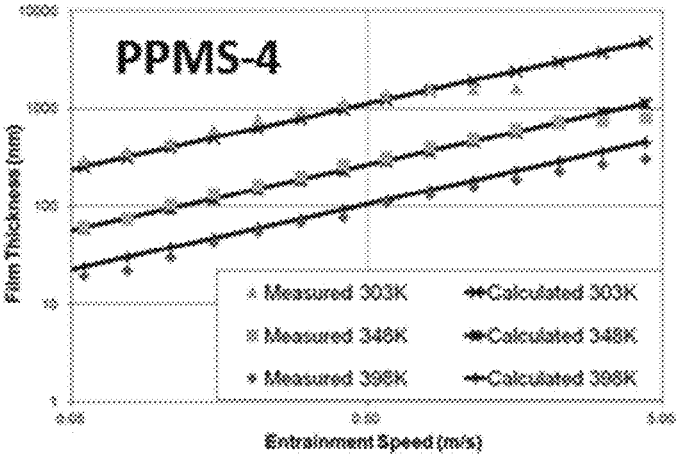

Referring now to FIGS. 6(A-C), temporary shear thinning is observed in the film formation for the PPMS base oil samples. The Hamrock-Dowson equation (see Equation 4) accurately predicts the film formation of the lower molecular mass sample, PPMS-1 (FIG. 6A) but over-predicts the film formation of the higher molecular mass sample, PPMS-2 (FIG. 6B). The non-Newtonian behavior depends on high molecular mass rather than high viscosity as illustrated by the two PPMS samples with viscosities around 500 $mm^2 \cdot s^{-1}$ (PPMS-2 & PPMS-4). The higher molecular mass PPMS base oil (PPMS-2; $M_w$=26,600 g/mol) produced a thinner film than the other PPMS base oil (PPMS-4: $M_w$=1,990 g/mol) of similar viscosity (compare FIGS. 6B and 6C).

Figure 7:
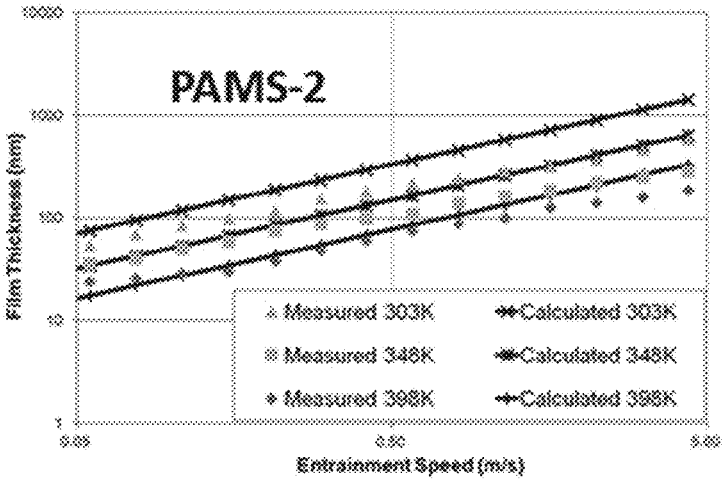
FIGS. 7(A-C) are graphical representations of elastohydrodynamic liquid (EHL) film thickness exhibited by polyalkylmethylsiloxane (PAMS) base oils plotted as a function of entrainment speed at various temperatures.
Figure 7:
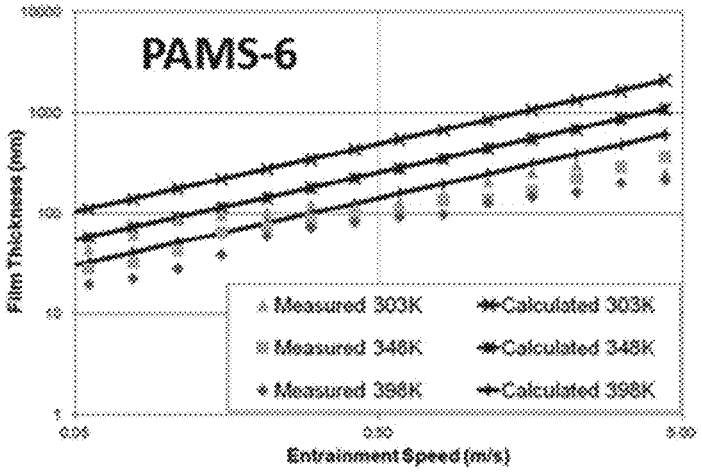
Figure 7:
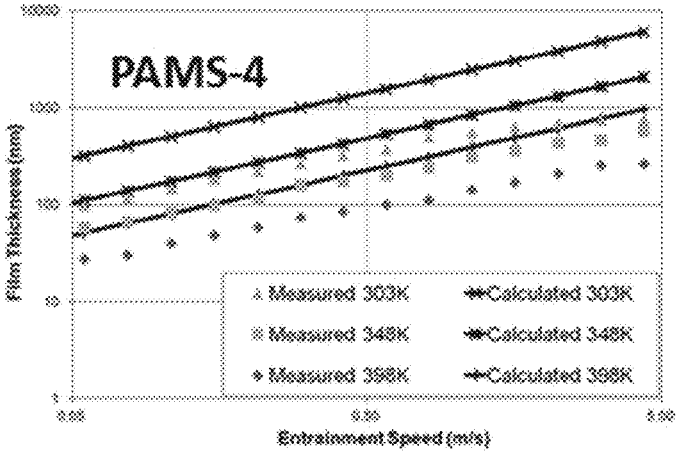

Referring now to FIGS. 7(A-C), temporary shear thinning also occurs in PAMS base oils, but with significant variation in the speed at on-set. Again, the Hamrock-Dowson equation (see Equation 4) accurately predicts the film formation of the lower molecular mass sample (PAMS-2) at low entrainment speed (FIG. 7A) but over-predicts the film formation at higher speeds. Base oils with increasing molecular mass such as PAMS-6 (FIG. 7B) and PAMS-4 (FIG. 7C) exhibit a behavior of earlier onset of shear thinning. Base oil samples PAMS-6 and PAMS-4 have significantly different D unit contents and polymer lengths.

Base oil sample PAMS-2 has a combination of D unit content and polymer length that make it nearly Newtonian for much of its performance range. PAMS-4 and PAMS-6 illustrate that shear thinning behavior can be attained with sufficient length (PAMS-6) or heavy D unit content (PAMS-4). Base oil sample PAMS-6 is most similar to conventional polydimethylsiloxane PDMS oil with only 8% dodecylmethyl D unit content. The PAMS-4 base oil has 100% dodecylmethyl D unit content and nearly twice the molecular mass of base oil sample PAMS-6.

The measurement of film thickness and friction coefficient over a range of entrainment speeds and slide to roll ratios allows the data to be cross-plotted (see FIG. 8) in order to determine the friction coefficient as a function of the lubrication regime. As shown by the data in FIG. 8, the friction decreases with increasing entrainment speed until the film thicknesses caused by the entrainment speed exceeds the composite roughness of the ball and disk, at about 30 nm. This represents the transition from mixed to full film lubrication.

Figure 8:
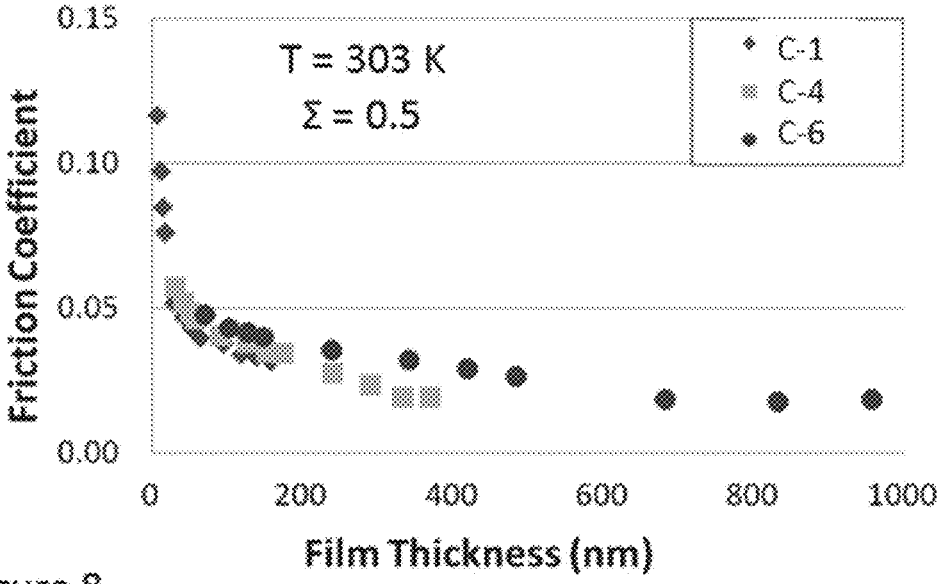
FIG. 8 is a graphical representation of the friction coefficient exhibited by conventional oils plotted as a function of entrainment speed.

Cross-plots of film thickness and friction coefficient were made for various conventional PDMS base oils (FIG. 8) and PPMS base oils (FIG. 9) prepared according to the teachings of the present disclosure. Referring specifically to FIG. 8, the lowest viscosity conventional PDMS oil (C-1) formed the thinnest film at low velocities as shown by the boundary friction in the region of film thickness below 30 nm. Each of the conventional PDMS samples show a similar EHD friction coefficient, with such coefficient increasing slightly with increasing viscosity over the range of 10 $mm^2 \cdot s^{-1}$ (C-1) to 1000 $mm^2 \cdot s^{-1}$ (C-6). The reduced EHD friction of the higher mass PDMS samples is attributed to the low pressure-viscosity index and shear thinning behavior that reduces the film thickness (see FIGS. 5(A-C)).

Figure 9:
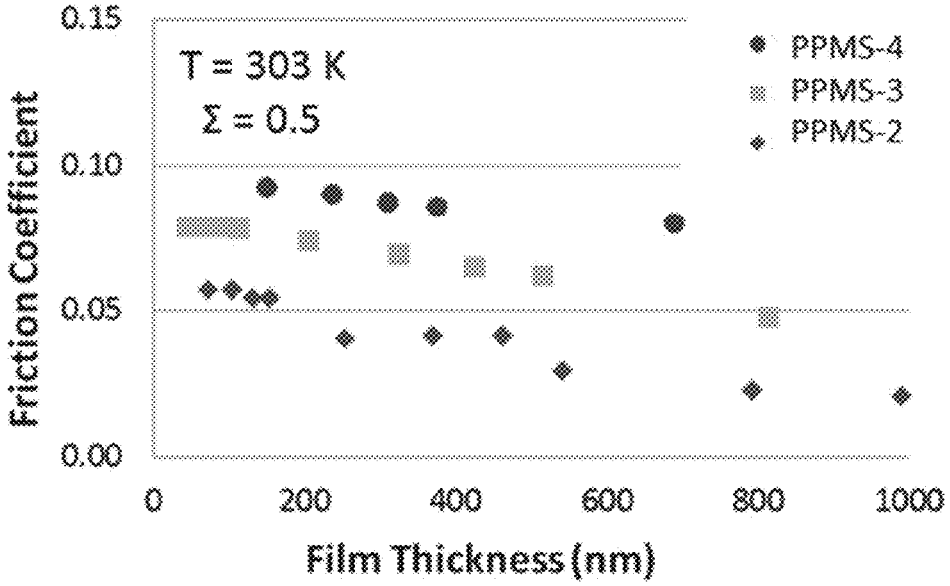
FIG. 9 is a graphical representation of the friction coefficient exhibited by PPMS base oils plotted as a function of entrainment speed.

Referring now to FIG. 9, the greatest variation in the EHD friction coefficient is shown in the PPMS base oil samples. The EHD friction of the PPMS polysiloxane base oils increase with increasing viscosity, but the most notable trend is the increase in the EHD friction coefficient as the phenylmethyl D unit content increases from 10% (PPMS-2) to 90% (PPMS-4). This illustrates that while both fluids have high film forming ability, the sample with low phenylmethyl content is subject to much lower energy loss due to hydrodynamic friction under the same operating conditions.

Figure 10:
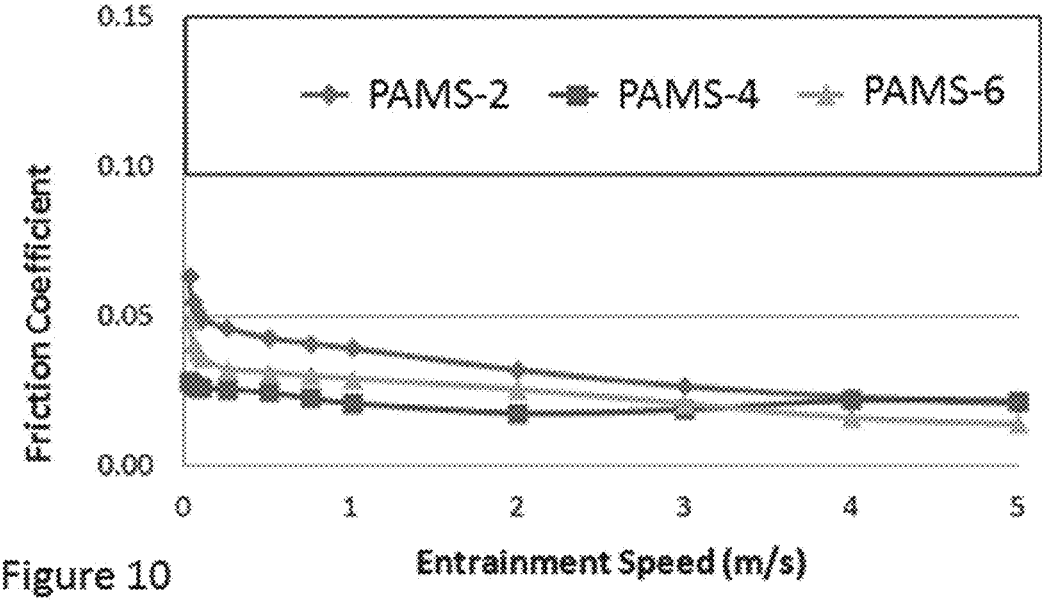
FIG. 10 is a graphical representation of the friction coefficient exhibited by PAMS base oils plotted as a function of entrainment speed.

Cross-plots of the friction and film thickness of the PAMS series of base oils require additional measurements of film thickness at different slide to roll ratios. However, the same shear thinning trends observed in the film formation (FIGS. 7A-7C) can be seen in the friction coefficients of the dodecyl branched alkylmethylsiloxanes (FIG. 10). Referring now to FIG. 10, the friction coefficient of PAMS-2 base oil, with nearly Newtonian film formation (FIG. 7A), is the highest of the three samples although its mass and viscosity are the lowest of the PAMS samples tested. Meanwhile, base oil PAMS-4 (FIG. 7C) has very low friction coefficient although its viscosity is the highest of all of the fluids under analysis. If EHD friction increased in proportion to bulk viscosity, then one would expect base oil PAMS-4 to exhibit more energy loss than PAMS-2 and PAMS-6.

The film formation and friction measurements show that certain siloxanes exhibit temporary shear thinning, or effective energy efficient behavior while others retain Newtonian behavior with higher EHD friction losses. Alkyl and phenyl branched siloxanes can be designed to have the same viscosity at a given temperature by variation of the phenyl or alkyl branch content. PPMS and PAMS base oils have also demonstrated Newtonian or non-Newtonian properties at a set viscosity related to their molecular structure. High mass samples of PPMS base oils (PPMS-2 $M_w$=26,600 g/mol) and PAMS base oils (PAMS-4 $M_w$=29,900 g/mol) exhibit the temporary shear thinning behavior in film thickness variation. The EHD friction of some of the shear thinning siloxanes show that the higher mass samples shear thin to film thickness and EHD friction that are similar to the low viscosity samples. The EHD friction of conventional PDMS sample C-6 shear thin to near the same value as conventional PDMS sample C-4 and the PPMS base oil PPMS-2 shear thin to nearly the same value as base oil sample PPMS-1.

Figure 11:
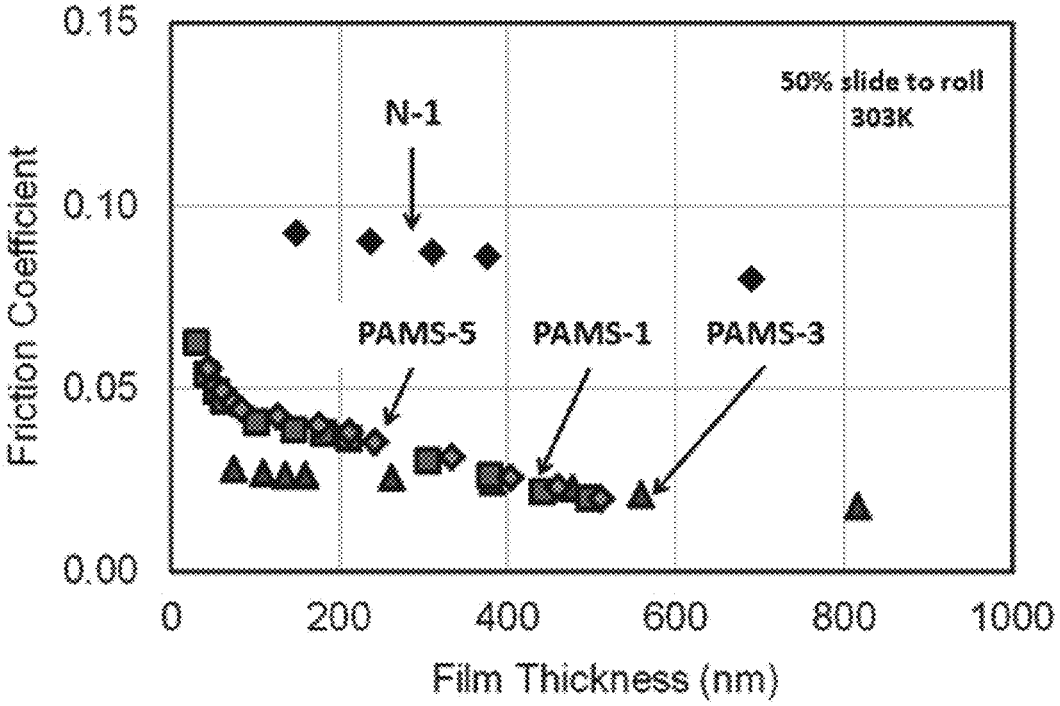
FIG. 11 is a graphical representation of the friction coefficient exhibited by PAMS base oils and a conventional Newtonian oil plotted as a function of film thickness.

Referring now to FIG. 11, the lower film friction exhibited by PAMS-based oils in comparison to Newtonian reference oil (N-1) can be attributable to shear thinning caused by molecular alignment of the non-Newtonian samples under high shear stresses. The polysiloxane base oils prepared according to the teachings of the present disclosure exhibit a coefficient of friction that is less than 0.07 at a temperature of at least 303 K with a EHL film thickness of 10 nm or more as demonstrated by samples PAMS-1, PAMS-3, & PAMS-5 in FIG. 11.

Figure 12:
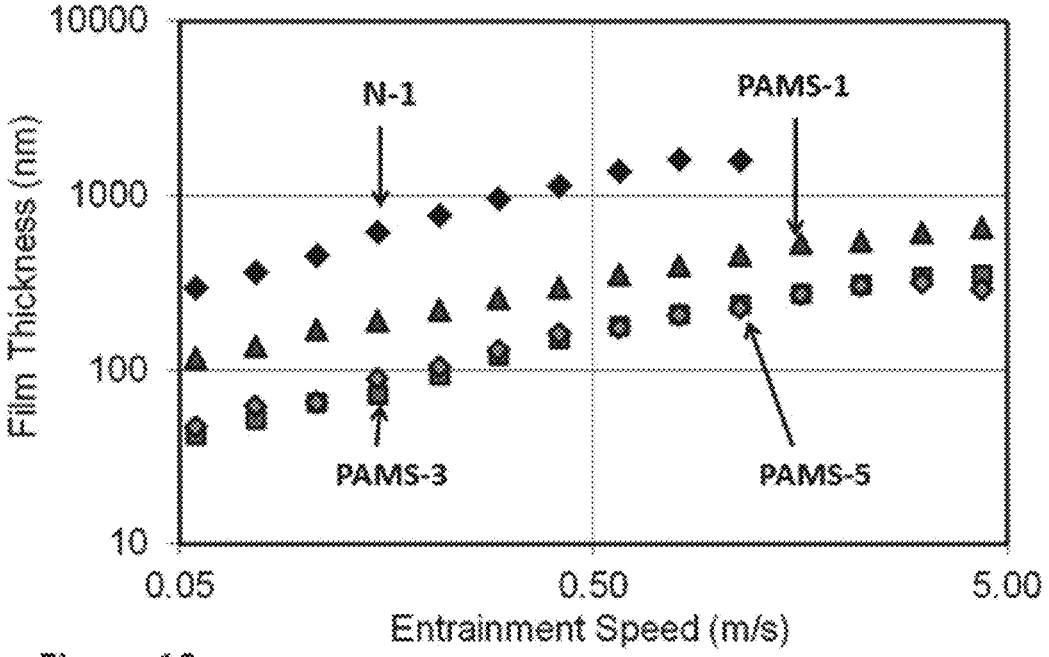
FIG. 12 is a graphical representation of the film thickness exhibited by PAMS base oils and a conventional Newtonian oil plotted as a function of entrainment speed.

In FIG. 12, the film thickness for the Newtonian siloxanes (N-1), which does not shear thin, and shear thinning siloxanes (PAMS-1, PAMS-3, & PAMS-5) are plotted as a function of entrainment speed and shown to be nominally pure rolling at a temperature of 303 K. The samples PAMS-1, PAMS-3, & PAMS-5 have lower film thickness than predicted by the Hamrock-Dowson equation (see Equation 4), yet still maintain sufficient film thickness to separate the running surfaces and minimize boundary friction and wear.

Figure 13:
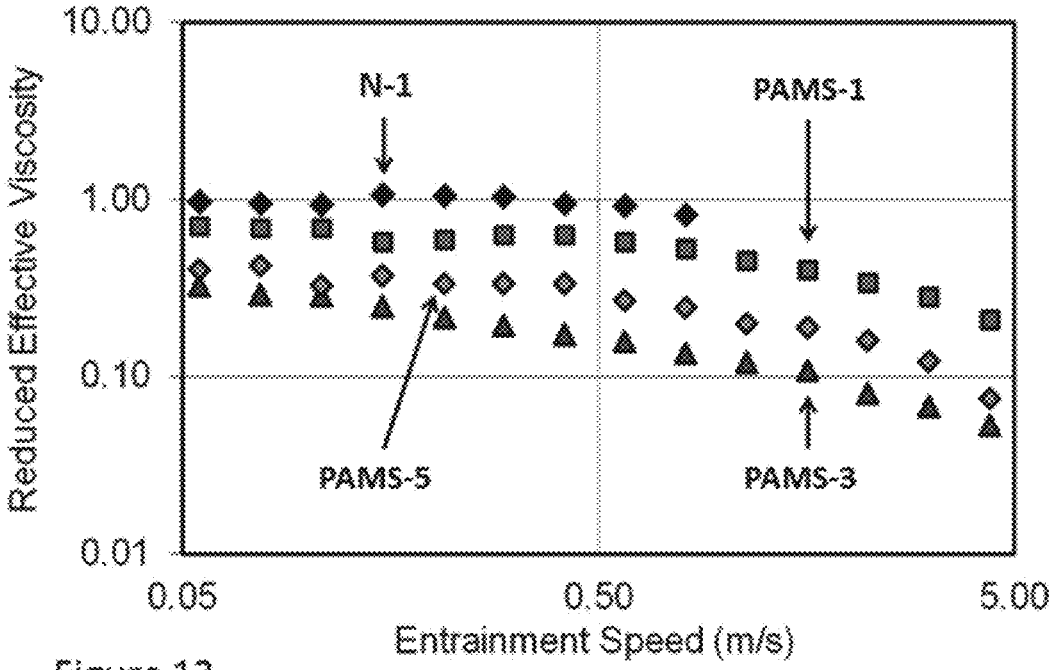
FIG. 13 is a graphical representation of the reduced effective viscosity exhibited by PAMS base oils in comparison to a conventional Newtonian oil plotted as a function of entrainment speed.

Referring now to FIG. 13, the reduced effective viscosity of the Newtonian reference fluid N-1 is unity (1) while the polysiloxane base oil samples (PAMS-1, PAMS-3, & PAMS-5) exhibit non-Newtonian shear thinning behavior resulting in an effective viscosity that is less than unity. FIG. 13 further illustrates that the effective viscosity decreases with increasing entrainment speed or shear rate.

Figure 14:
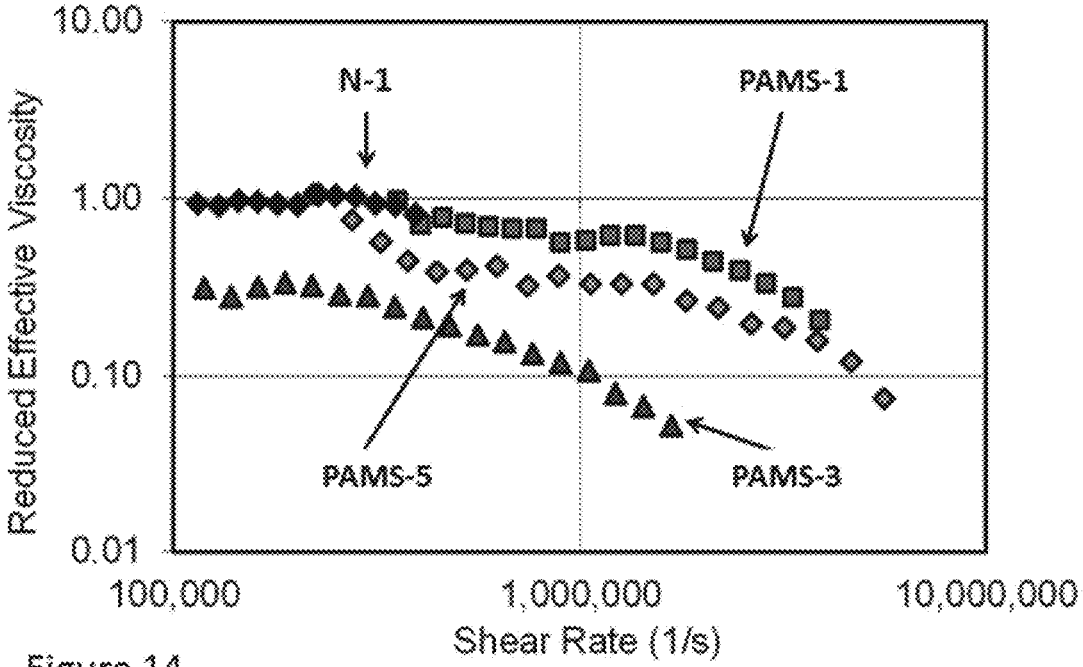
FIG. 14 is a graphical representation of the reduced effective viscosity of FIG. 13 plotted as a function of shear rate ($sec^{-1}$)

The shear rate ($\dot{\gamma}$) may be calculated from the quotient of the entrainment speed difference of the ball and disk ($U_1$-$U_2$) and the measured film thickness. FIG. 14 depicts the reduced effective viscosity as a function of shear rate illustrating the effect of increasing shear rate on shear thinning behavior. The effective viscosity of the shear thinning siloxanes (PAMS-1, PAMS-3, & PAMS-5) are shown to reduce to a value that is less than 10% of the bulk viscosity of the samples.

Figure 15:
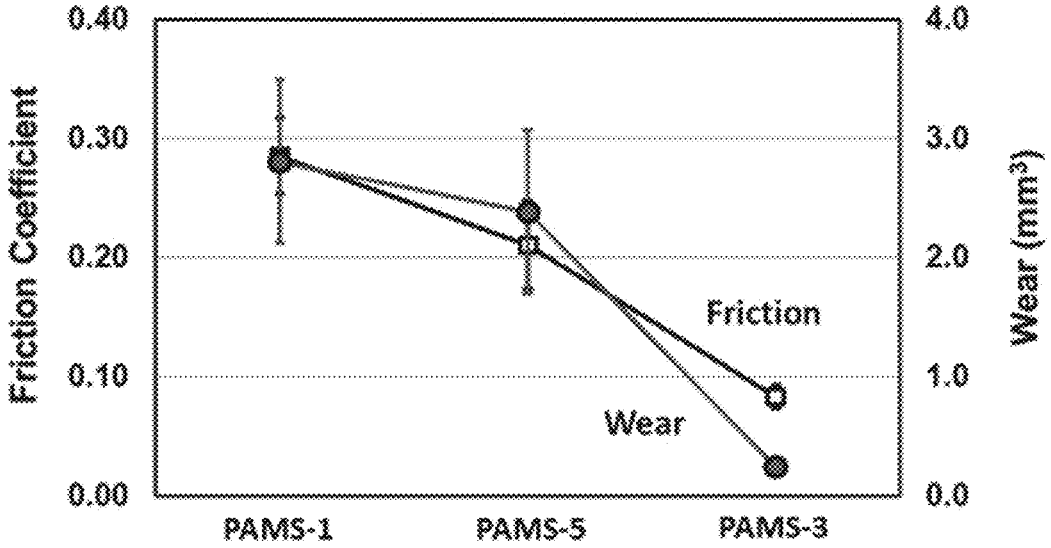
FIG. 15 is a graphical representation of the coefficient of friction and the wear measured for PAMS base oils prepared according to the present disclosure.

In FIG. 15 the reduction in boundary friction and wear that may be attained with highly branched shear thinning siloxanes is demonstrated. While all of the n-octyl branched siloxanes (PAMS-1, PAMS-3, & PAMS-5) exhibit low film friction due to shear thinning, not all samples reduce wear significantly.

The viscosity of several shear thinning samples, namely, conventional oil C-6 and polysiloxane base oil PPMS-2 measured after the film and friction measurements exhibit no permanent viscosity loss. While, the film and friction tests are not dedicated permanent shear tests, siloxanes are resistant to permanent shear. The competitive friction and wear performance, in addition to the potential to maintain the permanent shear resistance, make shear thinning siloxanes viable candidates for energy efficient lubricants. Therefore many siloxanes may have the dual benefit of resistance to permanent shear thinning while being subject to temporary shear thinning and its energy saving benefits.

Figure 16:
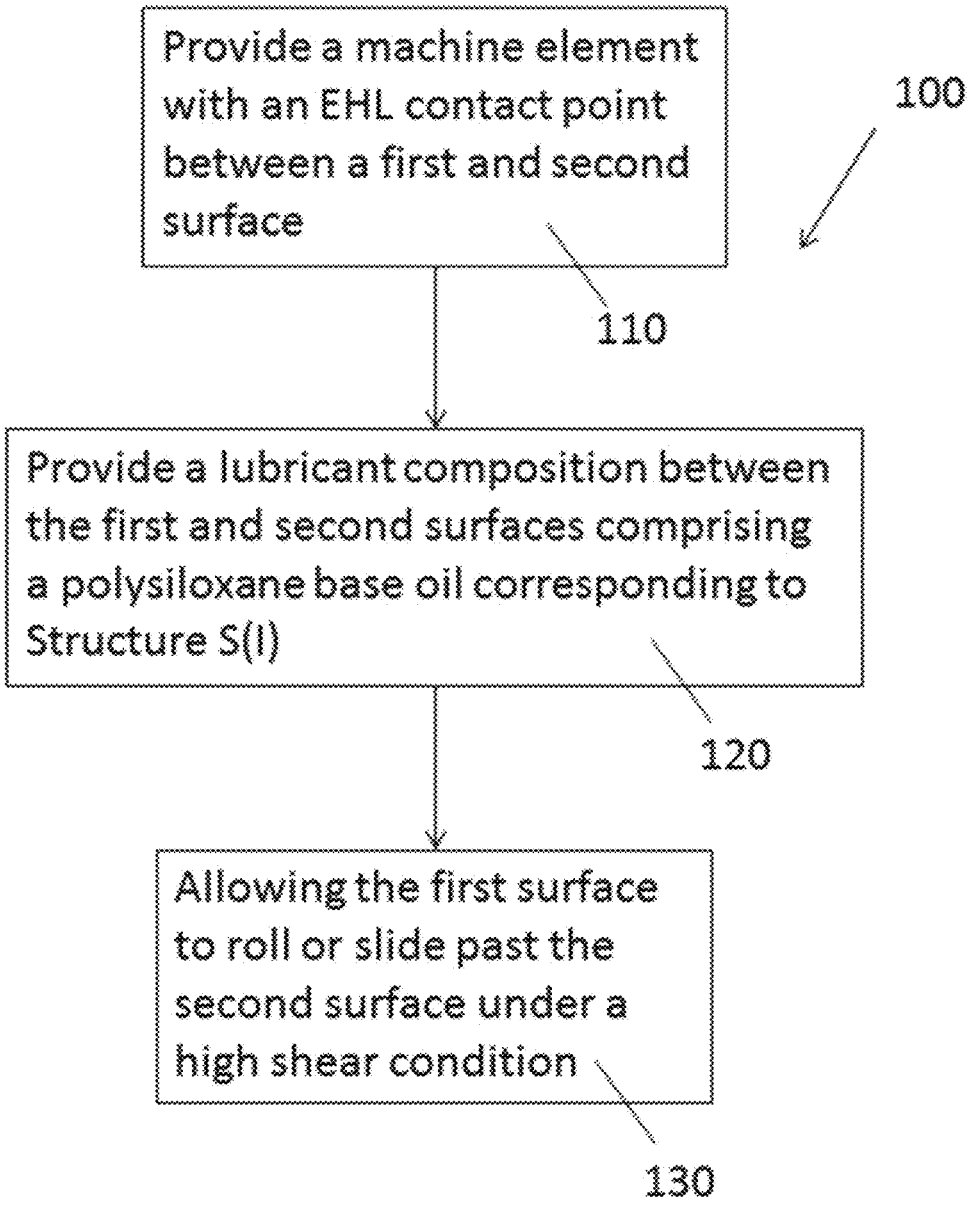
FIG. 16 is a schematic representation of a method of using a lubricant composition comprising a polysiloxane base oil to reduce the film friction between surfaces placed under a high shear condition.

According to another aspect of the present disclosure, a method of reducing the film friction between rolling or sliding surfaces in a machine element is provided. Referring now to FIG. 16, the method 100 generally comprises the steps of providing a machine element 110 having a first and second surface; providing a lubricant composition 120 between the first and second surfaces; and allowing the first surface to roll or slide past the second surface 130, thereby exposing the lubricant composition to a high shear condition. This high shear condition corresponds to a shear rate that is between about 1,000 $sec^{-1}$ and about 100,000,000 $sec^{-1}$; alternatively between 1,000 $sec^{-1}$ and 10,000,000 $sec^{-1}$; alternatively between 1,000 $sec^{-1}$ and 1,000,000 $sec^{-1}$; alternatively between 10,000 $sec^{-1}$ and 100,000 $sec^{-1}$. In this method, the two surfaces represent an elastohydrodynamic lubrication (EHL) contact point in the machine element. Alternatively, the first and second surfaces are ceramic or metal surfaces; alternatively, the two surfaces are metal surfaces. The machine element may include, but not be limited to, a rolling element bearing, a sliding bearing, a gear, a cam and cam follower, or a traction drive.

The lubricant composition used in this method 100 may include any of the polysiloxane base oils described herein corresponding to Structure S(I) as previously described herein; alternatively, the polysiloxane base oils correspond to either Structure SOD or S(III) as previously described herein. Optionally, the lubricant composition may further comprise at least one functional additive selected as one from the group of extreme pressure additives, anti-wear additives, antioxidants, antifoams, metal deactivators, detergents, dispersants, antibacterial agents, antiseptics, tackiness additives, friction modifiers, and corrosion inhibitors known to one skilled in the art.

The lubricant composition when used according to the method 100 provides an EHL film thickness between 10 and 2,000 nm at a temperature of 303K and an entrainment speed between 0.05 and 5.00 m/s. At a temperature of 398K the EHL film thickness of the lubricant composition ranges from about 10 to about 1,000 nm at an entrainment speed between 0.05 and 5.00 m/s. The lubricant composition also exhibits a coefficient of friction that is less than about 0.07 at a temperature of 303K and an entrainment speed between 0.05 and 5.00 m/s. The coefficient of friction exhibited by the lubricant composition at a temperature of 398K and an entrainment speed between 0.05 and 5.00 m/s is about 0.07.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method of reducing the film friction that occurs between two mechanical surfaces when the surfaces are moved relative to one another, said method comprising providing a lubricant composition between the two mechanical surfaces, the lubricant composition comprising at least one polysiloxane base oil; the polysiloxane base oil corresponding to the structural formula

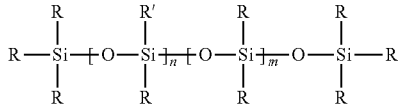

and exhibiting a coefficient of friction that is less than 0.07 at a temperature of at least 303 K with a EHL film thickness of 10 nm or more;

wherein R and R' are independently selected, such that R is an alkyl group having between 1-3 carbon atoms; R' is an alkyl group having between 6-20 carbon atoms; m is an integer, and n is an integer with the provisos that $25<(m+n)<500$ and $0.05<m/(m+n)<1.00$.

2. The method according to claim 1, wherein in the polysiloxane base oil R is a methyl group and R' is an alkyl group with between 6-12 carbon atoms; and $50<(m+n)<500$ and $0.05<m/(m+n)<0.30$.

3. The method according to claim 1, wherein the polysiloxane base oil corresponds to the structural formula:

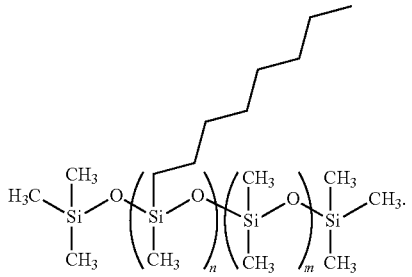

4. The method according to claim 1, wherein the lubricant composition comprises a second polysiloxane base oil including an aryl group.

5. The method according to claim 4, wherein the polysiloxane base oil has the structure:

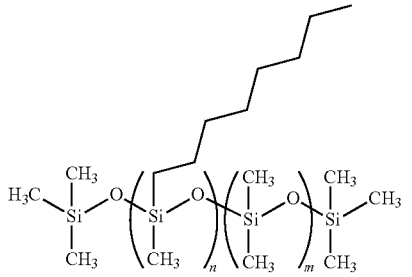

and the second polysiloxane base oil has the structure:

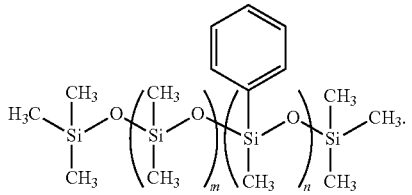

6. The method according to claim 1, wherein the polysiloxane base oil exhibits an initial viscosity ($\eta_o$) that decreases to an effective viscosity ($\eta_{eff}$) when exposed to the high shear condition; wherein the ratio of $\eta_{eff}/\eta_o$ is between 0.99 and 0.05.

7. The method according to claim 1, wherein the polysiloxane base oil exhibits a total mass in excess of 10,000 g/mol.

8. The method according to claim 1, wherein the lubricant composition further comprises at least one functional additive selected as one from the group of extreme pressure additives, anti-wear additives, antioxidants, antifoams, and corrosion inhibitors.

9. The method according to claim 1, wherein the two surfaces represent an elastohydrodynamic lubrication (EHL) contact point in a machine element.

10. The method according to claim 9, wherein the machine element is a sliding bearing, a rolling element bearing, a gear, a cam and a cam follower, or a traction drive, and optionally, the two surfaces are metal surfaces.

11. The method according to claim 1, wherein the lubricant provides one or more of the following: an EHL film thickness between the two surfaces that is less than 2000 nm, a coefficient of film friction less than 0.05 at a temperature of 398 K, and a coefficient of friction that is less than 0.25 at a shear rate less than 1,000 $sec^{-1}$.

12. A method of reducing film friction between rolling or sliding surfaces in a machine element, the method comprising the steps of:

providing a machine element having a first surface and a second surface; the first and second surfaces representing an elastohydrodynamic lubrication (EHL) contact point in the machine element;

providing a lubricant composition between the first surface and second surface, the lubricant composition comprising:

at least one polysiloxane base oil, free of non-silicone base oil, corresponding to the structural formula:

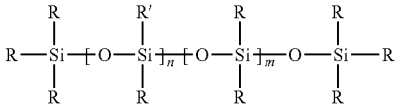

wherein R and R' are independently selected, such that R is an alkyl group having between 1-3 carbon atoms; R' is an alkyl group having between 6-20 carbon atoms; m is an integer, and n is an integer with the provisos that $25<(m+n)<500$ and $0.05<m/(m+n)<1.00$; and allowing the first surface to roll or slide past the second surface such that the lubricant composition is exposed to a high shear condition defined by a shear rate that is between 1,000 $sec^{-1}$ and 100,000,000 $sec^{-1}$;

wherein the lubricant composition exhibits a coefficient of friction that is less than 0.07 at a temperature of at least 303 K with a film thickness of 10 nm or more.

13. The method according to claim 12, wherein in the polysiloxane base oil R is a methyl group and R' is an alkyl group with between 6-12 carbon atoms; and $50<(m+n)<500$ and $0.05<m/(m+n)<0.30$.

14. The method according to claim 12, wherein the polysiloxane base oil corresponds to the structural formula:

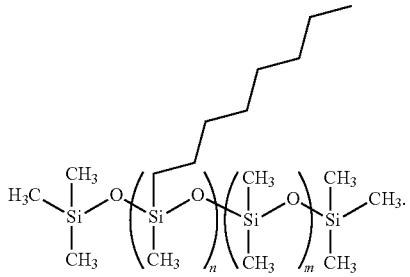

15. The method according to claim 12, wherein the lubricant composition further comprises a second polysiloxane base oil including an aryl group.

16. The method according to claim 15, wherein the polysiloxane base oil has the structure:

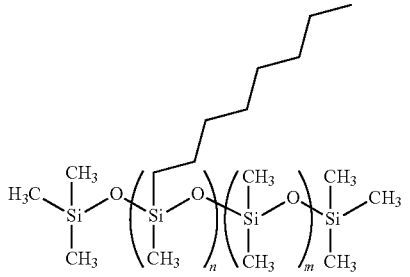

and the second polysiloxane base oil has the structure:

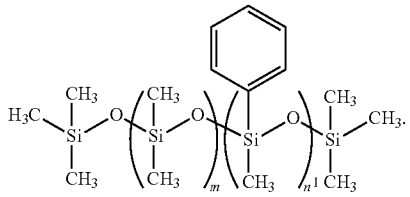

17. The method according to claim 12, wherein the machine element is a rolling element bearing, a gear, a cam and a cam follower, or a traction drive.

18. The method according to claim 12, wherein lubricant composition provides at least one of the following: an EHL film thickness between the first surface and second surface that is 2000 nm or less at a temperature of 303 K and 1000 nm or less at a temperature of 398 K; or a coefficient of friction less than 0.05 at a temperature of 398 K.

* * * * *